US006090020A

United States Patent [19]

Webber

[11] Patent Number: 6,090,020

[45] **Date of Patent: *Jul. 18, 2000**

[54] CONSTANT TENSION EXERCISE DEVICE

[76] Inventor: Randall T. Webber, 11162 Morning Creek Dr., San Diego, Calif. 92128

[ * ] Notice: This patent issued on a continued prosecution application filed under 37 CFR 1.53(d), and is subject to the twenty year patent term provisions of 35 U.S.C. 154(a)(2).

[21] Appl. No.: 09/013,423

[22] Filed: Jan. 26, 1998

Related U.S. Application Data

[63] Continuation-in-part of application No. 08/891,814, Jul. 14, 1997, Pat. No. 5,938,547, which is a continuation of application No. 08/410,979, Mar. 27, 1995, Pat. No. 5,681,247, which is a continuation of application No. 08/095,303, Jul. 21, 1993, Pat. No. 5,401,227, which is a continuation of application No. 07/658,100, Feb. 20, 1991, Pat. No. 5,236,406.

[51] Int. Cl.[7] ..... A63B 21/00

[52] U.S. Cl. ..... 482/100; 482/137; 482/138

[58] Field of Search ..... 482/100, 136, 482/137, 138, 99; 254/395

[56] References Cited

U.S. PATENT DOCUMENTS

| | | | |
|---|---|---|---|
| Re. 34,572 | 3/1994 | Johnson et al. | 482/99 |
| 515,714 | 2/1894 | Murphy | 254/395 |
| 4,563,003 | 1/1986 | Bugallo et al. . | |
| 4,709,918 | 12/1987 | Grinblat . | |
| 4,828,255 | 5/1989 | Lahman . | |
| 4,982,955 | 1/1991 | Heasley | 482/100 |
| 5,236,406 | 8/1993 | Webber | 482/100 |
| 5,316,534 | 5/1994 | Dalebout . | |
| 5,401,227 | 3/1995 | Webber | 482/100 |
| 5,419,751 | 5/1995 | Byrd et al. | 482/138 |
| 5,447,480 | 9/1995 | Fulks . | |
| 5,549,530 | 8/1996 | Fulks . | |
| 5,554,085 | 9/1996 | Dalebout | 482/100 X |
| 5,643,152 | 7/1997 | Simonson | 482/100 |
| 5,681,247 | 10/1997 | Webber | 482/100 |
| 5,785,635 | 7/1998 | Gerschefske et al. | 482/138 |

FOREIGN PATENT DOCUMENTS

| | | |
|---|---|---|
| 1586-724 | 8/1990 | U.S.S.R. . |

*Primary Examiner*—John Mulcahy
*Attorney, Agent, or Firm*—Brown, Martin, Haller & McClain, LLP

[57] ABSTRACT

An exercise device has a support frame and a lever arm attached to the support frame and pivotably movable between a rest position, wherein the lever arm hangs downwardly and an extended position, wherein the lever arm is pivoted relative to its rest position. A range of motion (ROM) device is rigidly attached to the lever arm, and pivots with the lever arm. The orientation of the ROM device relative to the lever arm can be selectively varied. A tackle is attached to the ROM device to provide an opposing force to motion of the lever arm from the rest position to the extended position. The tackle also includes a substantially taut cable that is connected to a mass.

14 Claims, 11 Drawing Sheets

CONSTANT TENSION EXERCISE DEVICE

This application is a Continuation-In-Part of pending application Ser. No. 08/891,814 filed Jul. 14, 1997 (U.S. Pat. No. 5,938,574), which was a Continuation of Ser. No. 08/410,979 filed Mar. 27, 1995 (U.S. Pat. No. 5,681,247), which was a Continuation of Ser. No. 08/095,303, filed Jul. 21, 1993 (U.S. Pat. No. 5,401,227), which was a Continuation of Ser. No. 07/658,100 filed Feb. 20, 1991 (U.S. Pat. No. 5,236,406).

FIELD OF THE INVENTION

The present invention relates generally to exercise devices. More particularly, the present invention relates to devices which can be used to exercise a particular muscle group of a person without requiring the use of free weights. The present invention particularly, though not exclusively, relates to weight machines.

BACKGROUND

Regular exercise, such as weight lifting, is widely known to increase a person's resistance to certain diseases, e.g., cardiovascular disease, and to generally improve a person's fitness, appearance, and overall physical and mental health. Accordingly, a regular exercise regimen that includes weight lifting is beneficial to many people.

Unfortunately, weight lifting requires the lifting and manipulation of relatively cumbersome and unwieldy free weights, leaving a novice or untrained lifter subject to injury. Not surprisingly, a number of devices have been introduced that make use of weights to improve the muscle tone and cardiovascular fitness, yet which avoid the risk of injury inherent with free weights. Such devices, familiarly referred to as "weight machines", typically include a manipulable mass that is lifted by the user through various mechanisms, such as levers and cable pulley systems. Regardless of the system used, weight machines typically restrict the motion of the mass to a single, vertical direction so that the mass cannot develop hard-to-control inertial motion in a lateral direction as it is being vertically lifted, which is the bane of free weights. Consequently, exercising with weight machines is comparatively safer than exercising with free weights.

Furthermore, the ability to isolate the force vector to a single direction permits weight machines to be designed to help the user focus on developing a preselected muscle—more so than may be possible through the use of free weights. More particularly, through the careful arrangement of levers, cables and pulleys, weight machines can be designed to force the user to exercise a particular muscle group, to the exclusion of other muscle groups. This focusing prevents the user from unintentionally "cheating" by using additional muscle groups to assist in lifting the mass.

To optimize the weight training benefit provided by a weight machine, it is desirable that the moving parts of the machine move smoothly while requiring the application of a substantially constant force to move the mass through its entire range of motion. It is also desirable that the machine be adjustable to accommodate the physiques of different users, both in terms of body strength and size. Moreover, it is desirable that the user of the machine be required to move the movable mass that is indicated on the machine throughout the entire range of motion of the mass, in order to provide a relatively accurate measure of the user's level of work/effort. The present invention recognizes that a weight machine can be provided that is adjustable to suit the requirements of different users and that requires a substantially constant force to move the mass through its entire range of motion.

Accordingly, it is an object of the present invention to provide an exercise device that is adjustable to suit more than one user. Another object of the present invention is to provide an exercise device that requires a substantially constant force to move the device through its range of motion. Further, it is an object of the present invention to provide an exercise device that has moving parts capable of being smoothly moved through their entire range of motion. Finally, it is an object of the present invention to provide an exercise device that is easy to use and cost-effective to manufacture.

SUMMARY

An exercise device has a support frame and a range-of-motion (ROM) block pivotably attached to the support frame. More particularly, one end of the ROM block is attached to a pivot shaft. The pivot shaft is in turn attached to the support frame, and the ROM block can pivot about the pivot shaft.

A lever arm is also pivotally attached to the support frame, and is rigidly connected to the ROM block by a dowel. Specifically, the dowel is attached to the lever arm and is selectively insertable into any one of a number of holes that are formed on the ROM block. Accordingly, the orientation of the lever arm relative to the ROM block can be established as desired by inserting the dowel into the appropriate hole on the ROM block.

Additionally, the lever arm has a handle that is positioned on the lever arm at a preselected distance from the pivot shaft. As envisioned by the present invention, the lever arm is pivotably movable from a rest, i.e., low energy, position to an extended, i.e., high energy, position wherein the lever arm with ROM block is pivoted from the rest position. A surface for supporting a person is attached to the support frame such that the person can grasp the handle of the lever arm and move the lever arm toward the extended position. Accordingly, the skilled artisan will appreciate that where the support surface is a seat, a person can sit in the seat and move the lever arm from the rest position to the extended position to simulate an exercise. The ROM block may be bi-directional, such that the lever arm may be moved in opposite directions from the rest position to perform difference exercises.

A tackle is connected to the lever arm to transfer a force to the lever arm that opposes movement of the arm toward the extended position. More specifically, the tackle includes at least two pulleys that are attached in tandem to the ROM block. At least one of the pulleys is positioned on the ROM block a predetermined distance from the pivot pin.

The tackle also includes a fixed block that is attached to the support frame, and at least two sheaves are attached in tandem to the fixed block. Furthermore, the tackle includes a cable that is guided partially around the periphery of each of the pulleys and sheaves. A first end of the cable is effectively attached to the support frame, and the second end of the cable is connected to a movable mass. As so arranged, the cable is maintained substantially taut throughout the entire range of motion of the lever arm.

In accordance with the present invention, the block-and-tackle is configured to transfer the magnitude of the weight of the mass, through the cable, to oppose movement of the lever arm toward the extended position. Importantly, the preselected distance of the lever arm handle from the pivot shaft and the predetermined distance from the ROM block pulleys to the pivot shaft are established such that the magnitude of the force required to move the lever arm toward the extended position is approximately equal to the magnitude of the weight of the mass.

The present invention further envisions that the first end of the cable can be attached to an elongated pull-down bar intermediate the ends of the bar. Also, a leg extension apparatus can be included on the device for exercising selected leg muscles. More specifically, the leg extension apparatus includes a lower roller that is attached to a pivot arm, and the pivot arm is in turn pivotably attached to the support frame and connected via a cable to the mass for opposing upward pivotable motion of the pivot arm. To support the user's upper leg, an upper roller is positioned on the support frame above the lower roller, and has an elevation relative to the support frame that is approximately as high as the seat. The elevation of the upper roller, however, can be adjusted as appropriate to suit the particular user of the device.

BRIEF DESCRIPTION OF THE DRAWINGS

The present invention will be better understood from the following detailed description of some preferred embodiments of the invention, taken in conjunction with the accompanying drawings, in which like numbers correspond to like parts, and in which.

DETAILED DESCRIPTION OF THE PREFERRED EMBODIMENTS

Figure 1:
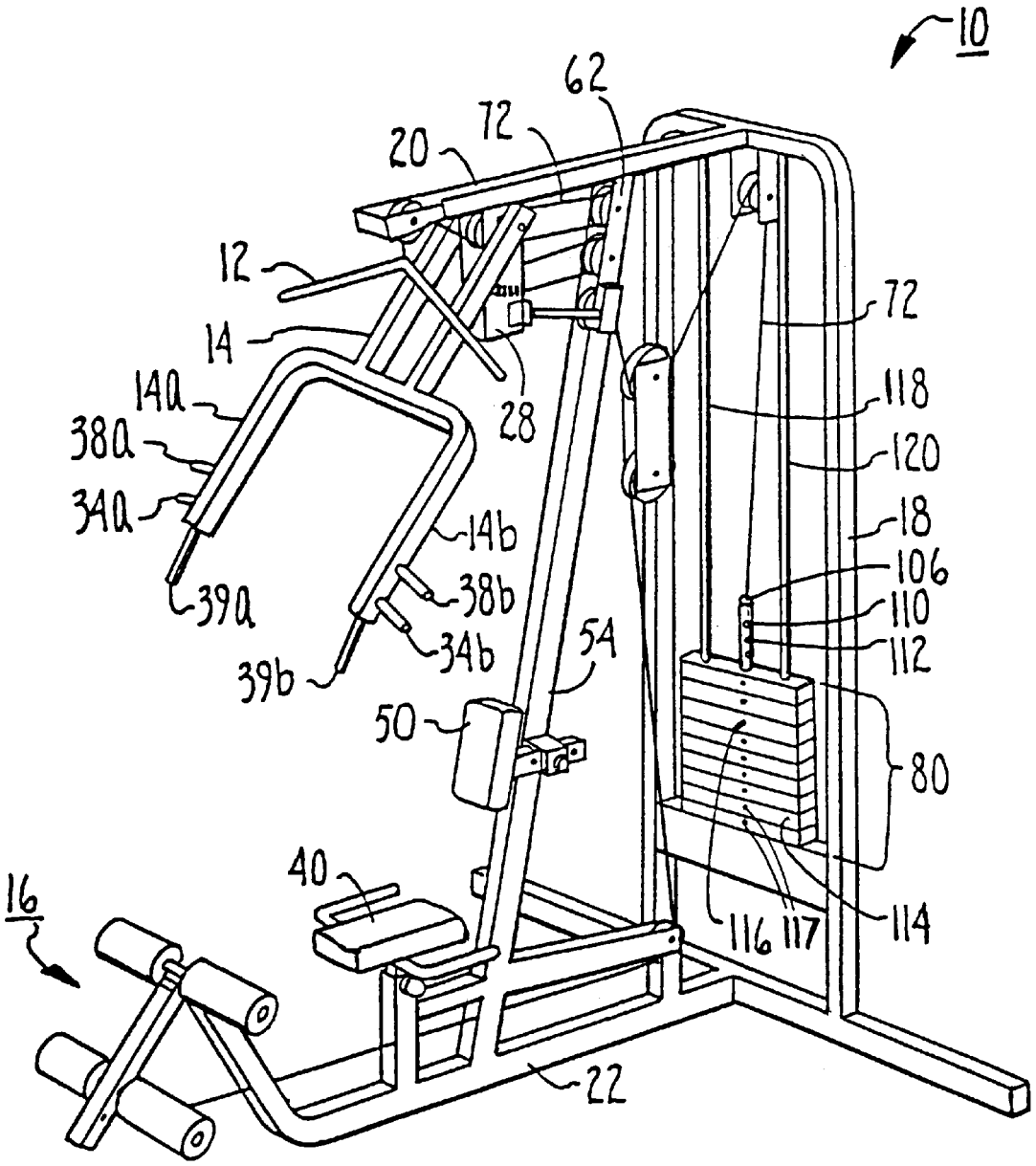
FIG. 1 is a perspective view of the exercise device of a first embodiment of the present invention, shown in its intended environment.

Referring initially to FIG. 1, an exercise machine 10 includes an elongated pull-down bar 12 and a lever arm 14, which functions as a chest press bar. As shown, the lever arm 14 is preferably formed with a pair of parallel gripping bars 14*a*, 14*b*. Additionally, the exercise machine 10 is preferably provided with a leg extension apparatus 16.

Figure 2A:
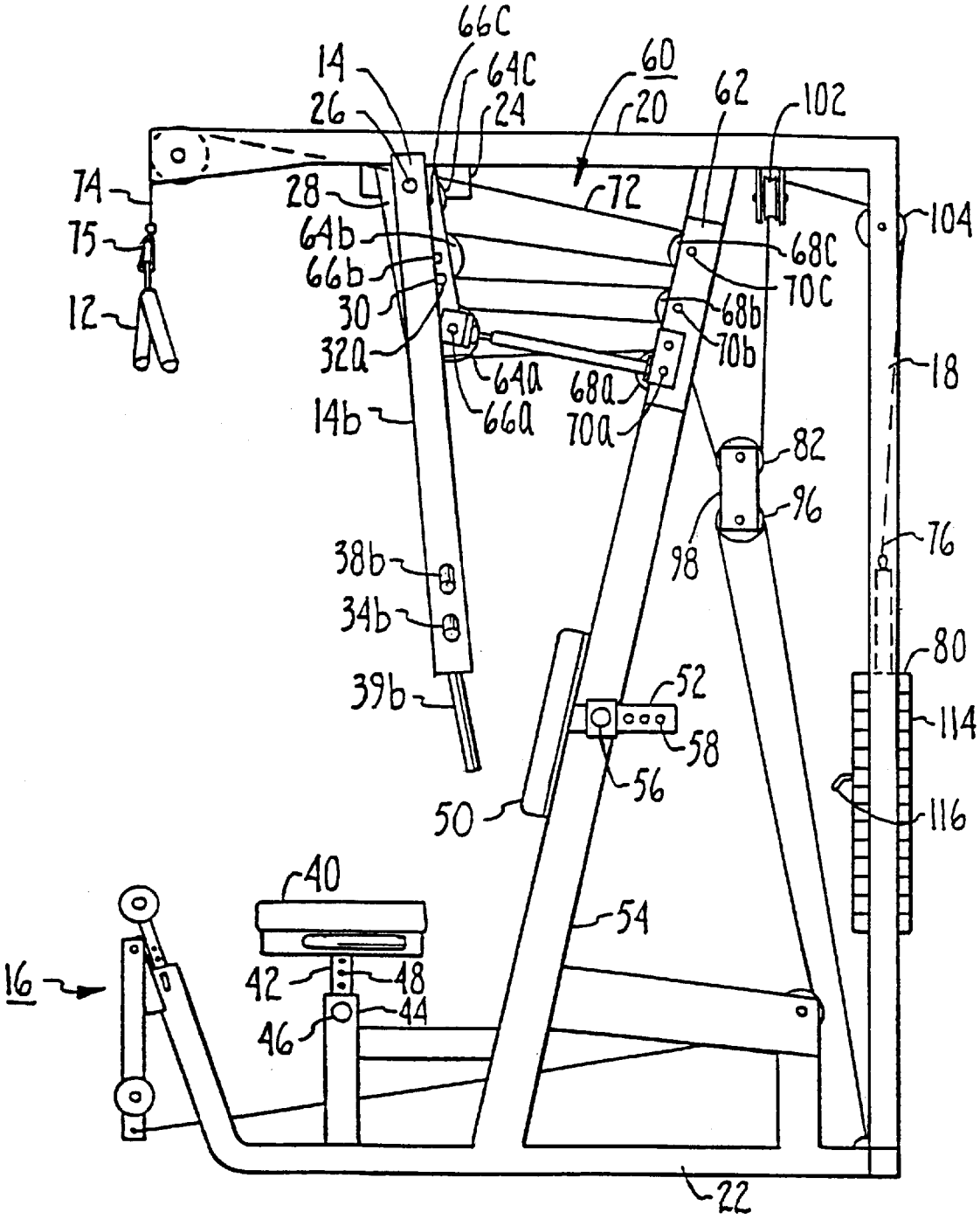
FIG. 2A is a side elevation view of the exercise device of FIG. 1, showing the lever arm in a rest position and showing a first orientation of the ROM block relative to the lever arm.

Now referring to FIG. 2A, the exercise machine 10 is shown to have a support frame 18 that has a top strut 20 and a bottom strut 22. A support flange 24 is fixedly attached to the top strut 20, and a pivot aperture is formed through the support flange 24. As shown in FIG. 2A, a pivot shaft 26 is mounted in the pivot aperture. In accordance with the present invention, the lever arm 14 is rotatably attached to the pivot shaft 26, permitting pivotable motion of the lever arm 14 relative to the top strut 20 between a rest position of the lever arm 14 shown in FIG. 2A and an extended position of the lever arm 14 shown in FIG. 2C. Additionally, FIG. 2A shows that a range of motion (ROM) block 28 is rotatably attached to the pivot shaft 26 for pivotable motion of the ROM block 28 relative to the top strut 20 of the support frame 18.

Figure 2B:
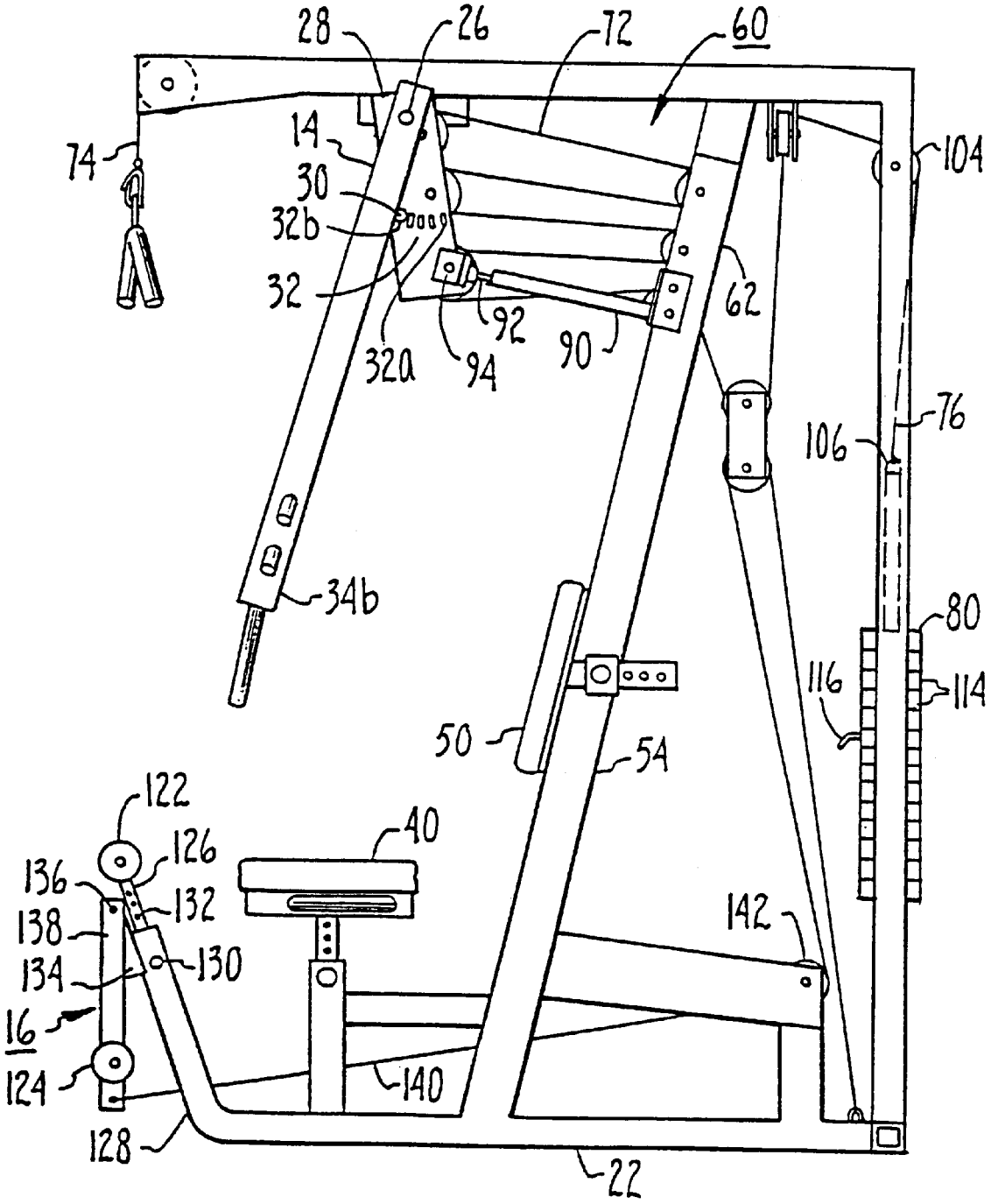
FIG. 2B is a side elevation view of the exercise device of FIG. 1, substantially similar to FIG. 2A, showing the lever arm in the rest position and showing a second orientation of the ROM block relative to the lever arm.

Importantly, as shown in cross-reference to FIGS. 2A and 2B, a dowel 30 is attached to the lever arm 14 and is insertable into one of a plurality of receiving holes 32 that are formed in the ROM block 28 to pivotally attached the ROM block 28 to the lever arm 14. It is to be appreciated in reference to FIGS. 2A and 2B that the orientation of the ROM block 28 relative to the lever arm 14 can be established by inserting the dowel 30 into a select one of the plurality of holes 32. For example, the dowel 30 can be inserted into a receiving hole 32*a* in order to establish the orientation of the lever arm 14 relative to the ROM block 28 shown in FIG. 2A. On the other hand, the dowel 30 can be extracted from the receiving hole 32*a*, the orientation of the lever arm 14 relative to the ROM block 28 adjusted as desired, and the dowel 30 inserted into a second receiving hole 32*b*, to establish a different orientation of the lever arm 14 relative to the ROM block 28, as shown in FIG. 2B. Thus, while the rest position of the ROM block 28 does not change relative to the top strut 20 or the support frame 18, the orientation of the lever arm 14 relative to the support frame 18 that corresponds to the rest position of the ROM block 28 can be selectively established.

Figure 2C:
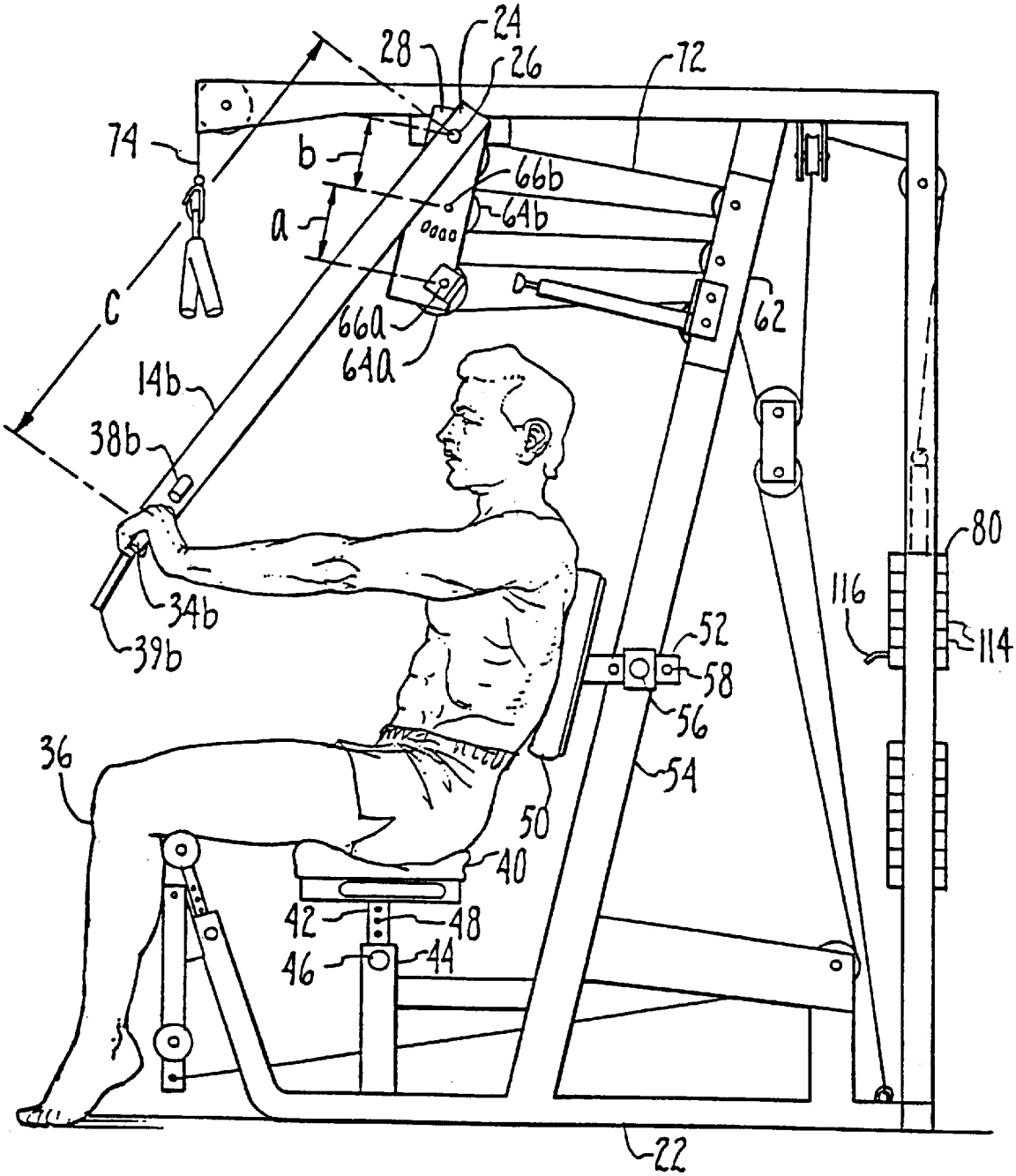
FIG. 2C is a side elevation view of the exercise device of FIG. 1, substantially similar to FIG. 2B, showing the lever arm in the extended position.

In cross-reference to FIGS. 1, 2A, and 2C, a gripping handle 34*a* is shown attached to or formed integrally with the gripping bar 14*a* and a gripping handle 34*b* is similarly attached to the gripping bar 14*b*, permitting a person 36 (shown in FIG. 2C) to grip the handles 34*a* and 34*b* and move the lever arm 14 toward an extended position. If desired, a second handle pair 38*a,b* and a third handle pair 39*a,b* can be formed on the gripping bars 14*a,b* to permit the person 36 to vary the location of his grip on the lever arm 14.

As best shown in FIG. 2A, a padded seat 40 is movably mounted on the support frame 18. More particularly, the seat 40 has a seat post 42 that is slidably engaged with a hollow riser 44 of the support frame 18. A seat dowel 46 is insertable through a hole (not shown) that is formed in the hollow riser 44, and the dowel 46 can also be inserted as appropriate into one of a plurality of riser holes 48 that are formed in the seat post 42 to establish the desired height of the seat 40 relative to the bottom strut 22. Also, a padded back support 50 having an extending post 52 with a plurality of post holes 58 is slidably engaged with a main riser 54 of the support frame 18. The position of the back support 50 relative to the main riser 54 can be established as desired by appropriately engaging a back support dowel 56 with one of the post of holes 58 formed in the extending post 52. It will be appreciated by the skilled artisan that the person 36 can sit in the seat 40, grasp the gripping handles 34 about chest-high, and urge the lever arm 14 toward the extended position, shown in FIG. 2C, to simulate a free weight bench press exercise.

Still referring to FIG. 2A, the ROM block 28 is shown operatively engaged with a tackle 60. As shown, the tackle 60 connects the ROM block 28 to a fixed block 62, which is mounted on the main riser 54. The tackle 60 includes three disc-shaped pulleys 64*a*, 64*b*, 64*c*, which are preferably rotatably mounted in tandem on the ROM block 28. Alternatively, however, the disc-shaped pulleys 64*a*, 64*b*, and 64*c* could be mounted side-by-side on the ROM block 28, i.e., the disc-shaped pulleys 64*a*, 64*b*, 64*c* can be mounted on the ROM block 28 coaxially with one another. In the embodiment shown in FIG. 2A, each of the disc-shaped pulleys 64*a*, 64*b*, 64*c* has a respective pulley axis shaft 66*a*, 66*b*, 66*c*, each of which is attached to the ROM block 28. As envisioned by the present invention, the disc-shaped pulleys 64 are rotatable about their respective pulley axis shafts 66.

As shown in FIG. 2A, the tackle 60 also includes three disc-shaped sheaves 68*a*, 68*b*, and 68*c*, which are rotatably mounted on the fixed block 62. More particularly, the three sheaves 68*a*, 68*b*, 68*c* are rotatably mounted on respective sheave axis shafts 70*a*, 70*b*, and 70*c* that are attached to fixed block 62. Additionally, the tackle 60 includes a cable 72, such as a conventional ⅛ inch diameter or 3⁄16 inch diameter nylon coated steel cable, that is guided partially around the peripheries of each of the three pulleys 64*a*, 64*b*, 64*c* and the three sheaves 68*a*, 68*b*, 68*c*. Specifically, the tackle cable 72 has a first cable end 74 that is attached to a connecting ring 75 of the pull-down bar 12, and a second cable end 76 that is attached to a movable mass 80 (best shown in FIG. 1). The cable 72 extends from the first cable end 74, serially around each of the three pulleys 64*a–c* and the three sheaves 68*a–c*, to the second cable end 76.

More specifically, in accordance with the cable pathway shown in FIG. 2A, the tackle cable 72 extends serially from the periphery of the first of the three pulleys 64*c*, to the periphery of the first of the three sheaves 68*c*, to the periphery of the second of the three pulleys 64*b*, and to the periphery of the second of the three sheaves 68*b*. From the second of the sheaves 68*b* the cable 72 extends partially around the periphery of the third of the three pulleys 64*a*, to the periphery of the third of the three sheaves 68*a*, and to the periphery of a first guide pulley 82.

It is to be understood that in the event pull-down bar 12 is omitted, the first pulley 64*c* and the first sheave 68*c* can also be omitted, in which case the first cable end 74 of the cable 72 would be attached to ROM block 28 or main riser 54. Furthermore, second pulley 64*b* can be omitted when pull-down bar 12 is omitted, and ROM block 28 lengthened as appropriate for establishing the predetermined distance between pulley 64*b* and pivot shaft 26, as more fully disclosed below.

As shown best in FIG. 2C for the preferred embodiment, the second and the third pulleys 64*b*, 64*a* are positioned on the ROM block 28 such that the respective axis shafts 66*b*, 66*a* are spaced apart a distance "a". Furthermore, the second pulley 64*b* is positioned on the ROM block 28 such that the axis shaft 66*b* is spaced a predetermined distance "b" from the pivot shaft 26. Also, the gripping handles 34*a*, 34*b* (only one handle is shown in FIG. 2C) are positioned on the lever arm 14 a preselected distance "c" from the pivot shaft 26. In accordance with the present invention, the distances a, b, and c are established such that a force of substantially equal magnitude to the magnitude of the weight of the movable mass 80 is conveyed to the handle 34. Moreover, substantially all of this force tends to oppose movement of the lever arm 14 toward its extended position. In other words, the substantially the entire magnitude of the weight of the movable mass 80 is transferred through the tackle 60 and the lever arm 14 to the gripping handles 34*a*, 34*b* to oppose movement of the lever arm 14 toward the extended position, permitting the person 36 to directly set the work level in accordance with the weight of the movable mass 80.

Referring momentarily to FIG. 2B, an elongated rest stop 90 having a resilient tip 92 is shown attached to the main riser 54. Resilient tip 92 of the rest stop 90 can contact a rest pad 94 that is mounted on the ROM block 28 to limit motion of the ROM block 28 and thereby establish the rest position of ROM block 28 with respect to the support frame 18. As shown, the rest stop 90 is positioned to establish a rest position of the ROM block 28 such that the tackle cable 72 is perpetually taut throughout the range of motion of the lever arm 14, for all orientations of the lever arm 14 relative to the ROM block 28.

To facilitate the relatively smooth motion of the tackle cable 72 during operation of the exercise machine 10, various guide pulleys are appropriately positioned to contact and guide the tackle cable 72 between the third sheave 68*a* and the second cable end 76. Specifically, in reference to FIG. 2A, the first guide pulley 82 and a second guide pulley 96 are rotatably mounted on a guide pulley block 98, which is not attached to any other of the structure of frame 18. As shown, the tackle cable 72 passes partially around the periphery of the first guide pulley 82 as well as partially around the periphery of a third and a fourth guide pulley 102,104, both of which are rotatably mounted on the support frame 18. Finally, the second cable end 76 (shown in phantom) of the tackle cable 72 is connected to a connector fitting 106 (also shown in phantom in FIG. 2A) which is attached to a weight transfer rod 110.

As shown in FIG. 1, the transfer rod 110 has formed therein a plurality of apertures 112 that extend transversely through the transfer rod 110. Further, to establish the movable mass 80, a plurality of metal bricks 114 are selectively engaged with the transfer rod 110. More specifically, the transfer rod 110 extends through central passageways (not shown) formed in the center of each brick 114. To establish the number of the metal bricks 114 that are to be included in the movable mass 80 lifted by the person 36, a brick retention peg 116 can be selectively inserted into any one of a plurality of retention apertures 117. As shown in FIG. 1, a retention aperture 117 is formed in each of the metal bricks 114, and the retention peg 116 is received simultaneously by the selected retention aperture 117 and the rod aperture 112. Thus, because the metal bricks 114 are vertically stacked, a predetermined number of metal bricks 114 can be held onto the weight transfer rod 110 by placing the brick retention peg 116 in the retention aperture 117 of the brick that, when combined with those lying above, provide an aggregate weight that corresponds to the desired weight. Also, each metal brick 114 is slidably engaged with a pair of anti-sway bars 118, 120 which are connected to the support frame 18 to guide the metal bricks 114 up and down with respect to the support frame 18 when the lever arm 14 is moved.

Figure 3:
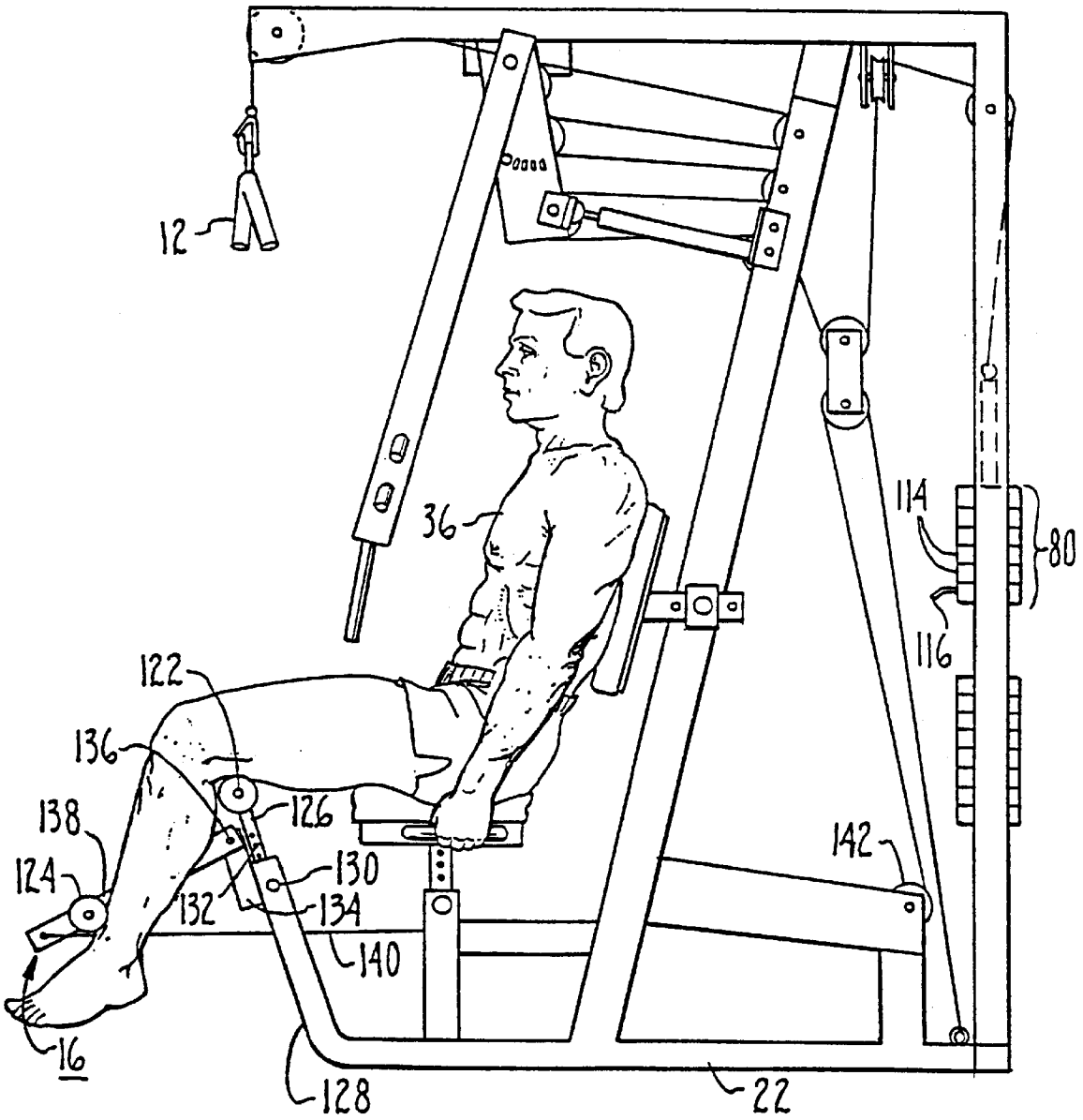
FIG. 3 is a side elevation view of the leg extension apparatus of FIG. 1, showing the lever arm in a forward rest position similar to FIG. 2B, with the lever arm in a different orientation.

Referring now to FIGS. 2B and 3, the details of the leg extension apparatus 16 are shown to include an upper padded roller 122 and a lower padded roller 124. The upper roller 122 is rotatably attached to an upper roller shaft 126, which in turn is slidably engaged with a hollow tube segment 128 formed in the bottom strut 22. A retention stud 130 can be inserted into the tube segment 128 and through one of a plurality of retention holes 132 formed in the upper roller shaft 126, to rigidly connect the upper shaft 126 to the tube segment 128.

Accordingly, it is to be understood that the elevation of the upper roller 122 with respect to the bottom strut 22 can be selectively established according to the desire of the person 36 by inserting the retention stud 130 into the appropriate retention hole 132. For example, the upper roller 122 can be positioned at a relatively high elevation, to permit the person 36 to anchor his legs beneath the roller 122 for performing lat pull-down exercises. On the other hand, the roller 122 can be positioned at a relatively low elevation to permit the person 36 to drape his knees over the roller 122 for performing leg extension exercises.

Still referring to FIGS. 2B and 3, a support flange 134 is shown connected to the tube segment 128, and a pivot pin 136 extends transversely through the support flange 134. A pivot arm 138 is rotatably engaged with the pivot pin 136, and thus is pivotably connected to the support flange 134. As shown, the lower roller 124 is rotatably mounted on pivot arm 138. In accordance with the present invention, the pivot arm 138 is movable between a rest position, shown in FIG. 2B, and an extended position, shown in FIG. 3.

To provide a means for transferring a force to the pivot arm 138 that will oppose motion of the pivot arm 138 toward the extended position shown in FIG. 3, a weight transfer cable 140 is attached to the pivot arm 138 and extends partially around the periphery of a fifth guide pulley 142. The weight transfer cable 140 extends around the second guide pulley 96 and is attached to the bottom strut 22, so that a force that opposes motion of the pivot arm 138 toward the extended position is transferred through the guide pulley block 98 and the weight transfer cable 140 to the pivot arm 138. ROM block 28 can alternatively be attached to bottom strut 22 and the block-and-tackle system disclosed above configured as appropriate to transfer the weight of mass 80 to lever arm 14. Also, the distances a, b, and c can be established such that the magnitude of the force required to move lever arm 14 toward the extended position exceeds the magnitude of the weight of mass 80.

It is to be appreciated that machine 10 can be made of any suitable material well-known in the art. For example, lever arm 14 and frame 18 can be made of a strong material, such as steel or other composite material. Bricks 114 can be made of a suitable heavy material, e.g., iron, iron alloy, or encased sand. If desired, bricks 114 can be replaced with manually-loaded disc-shaped weights (not shown), familiarly referred to as weight plates. Furthermore, pulleys 64 and sheaves 68 can be suitable steel or hard plastic discs which are appropriately configured to guide a cable around their respective peripheries.

Figure 4B:
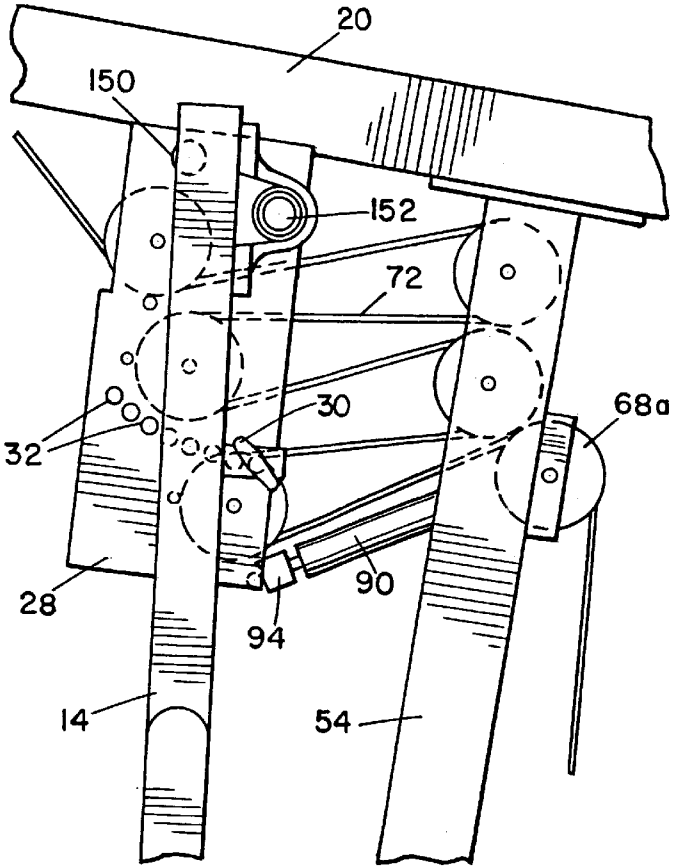
FIG. 4B is a side elevation view similar to FIG. 4A but showing the lever arm in a rearward rest position relative to the ROM block.
Figure 4A:
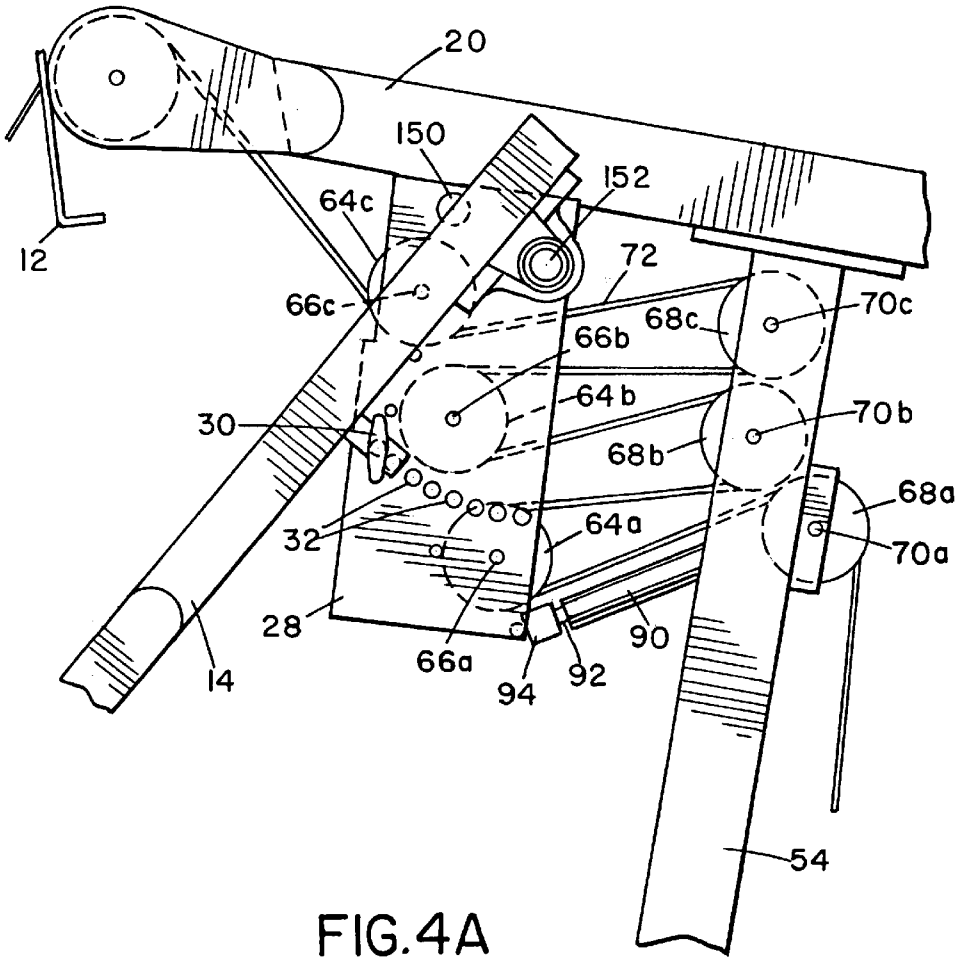
FIG. 4A is a side elevation view of an upper part of an exercise apparatus according to another embodiment of the invention, having a modified ROM block and lever arm arrangement, showing the lever arm in a forward rest position relative to the ROM block.

FIGS. 4A and 4B illustrate a modified ROM block and lever arm arrangement in which the block and lever arm are not pivoted on the same axis. The arrangement is otherwise identical to that of FIGS. 1 to 3, and like reference numerals have been used for like parts as appropriate. ROM block 28 is pivoted to the frame on pivot shaft 150, while the lever arm 14 is pivoted to the ROM block 28 via pivot shaft 152. FIGS. 4A and 4B illustrate the ROM block in a rest position in which it rests against the rest stop tip 92, with the lever arm 14 secured in two different orientations relative to the ROM block, by appropriate selection of the opening 32 through which dowel 30 extends, as in the previous embodiment.

Apart from the different location of the lever arm pivot 152, operation of the ROM block and lever arm in this embodiment is identical to that of the previous embodiment.

In the embodiment of FIGS. 1 to 3, the cable 72 extends around a series of pulleys and is then connected directly to the weight stack 114. FIGS. 5A to 5D illustrate several alternative linkages from the ROM block of FIGS. 1 to 3 or FIG. 4 to the weight stack or resistance 114. Although the resistance is a weight stack in the illustrated embodiments, it will be understood that any alternative forms of exercise resistance, such as springs or the like, may be used. In the embodiment of FIG. 5A, cable 72 is secured at one end 154 to the frame, extends around a pulley 155 at the top of the weight stack, and then around guide pulley 156 to the ROM block and tackle pulleys 157.

Figure 5B:
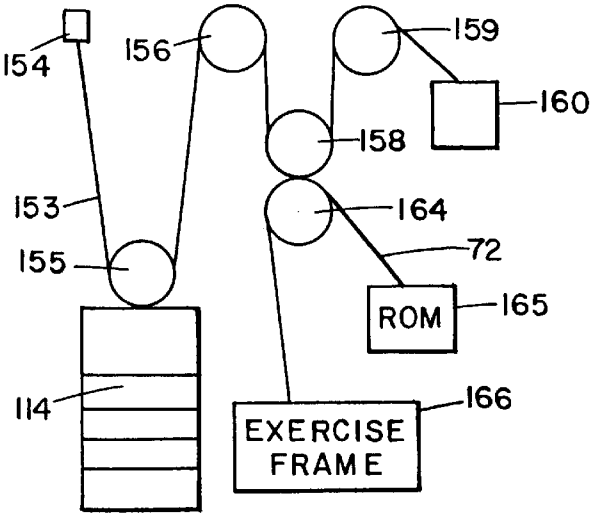
FIG. 5B is a schematic illustration similar to FIG. 5A showing an alternative linkage.
Figure 5A:
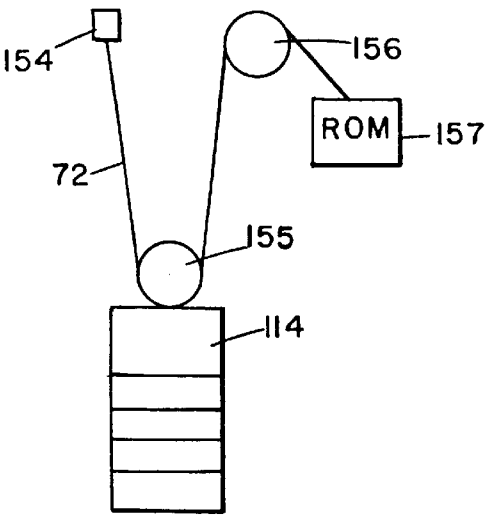
FIG. 5A is a schematic illustration of a modified cable linkage to a weight stack for the apparatus of FIGS. 1 to 3 or FIGS. 4A and B.

In the alternative illustrated in FIG. 5B, a first cable 153 extends from a fixed point on the frame or an exercise station 154 around weight stack pulley 155, then around guide pulley 156 to the upper pulley 158 of a double floating pulley arrangement. From pulley 158, cable 153 extends around a further guide pulley 159 and is connected to another exercise station 160. Second cable 72 extends around the lower pulley 164 of the double floating pulley. The cable 72 is linked to the ROM block and tackle pulleys 165, while the opposite cable end 166 may be connected to a further exercise station or to the frame.

Figure 5D:
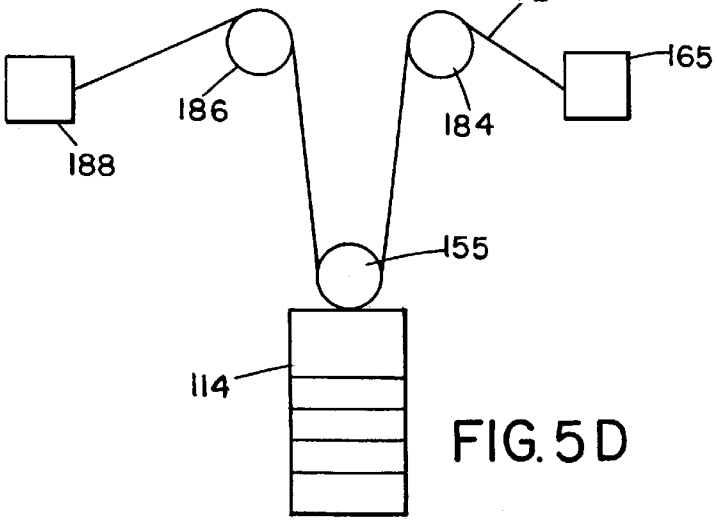
FIG. 5D is a schematic illustration similar to FIGS. 5A to 5C showing another alternative linkage.
Figure 5C:
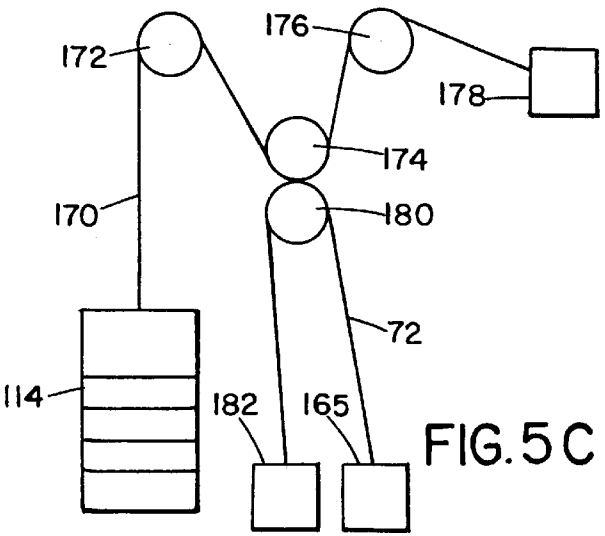
FIG. 5C is a schematic illustration similar to FIGS. 5A and 5B showing another alternative linkage.

FIG. 5C illustrates another alternative arrangement in which a first cable 170 extends from the weight stack or resistance 114 around a guide pulley 172, the upper pulley 174 of a double floating pulley arrangement, a second guide pulley 176, and out to an exercise station 178. Cable 72 extends from the ROM assembly 165 around a lower pulley 180 of the double floating pulley arrangement and then to a further exercise station 182 or alternatively to a tie-off point on the frame.

In the alternative of FIG. 5D, the cable 72 extends from the ROM assembly 165 around a guide pulley 184, around a pulley 155 linked to the weight stack or resistance 114, and then around a further guide pulley 186 to another exercise station 188. It will be understood by those skilled in the field that the constant tension exercise device of this invention may be linked to the exercise station in numerous alternative ways, including a direct engagement with the mass or resistance and arrangements in which the cable does not directly link to the weight stack or resistance but instead engages another cable which is linked to the mass, as in FIGS. 5B and 5C.

Figure 6B:
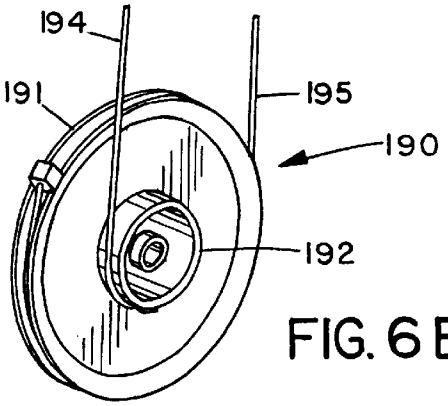
FIG. 6B is a perspective view of the cam and pulley element of FIG. 6A.
Figure 6A:
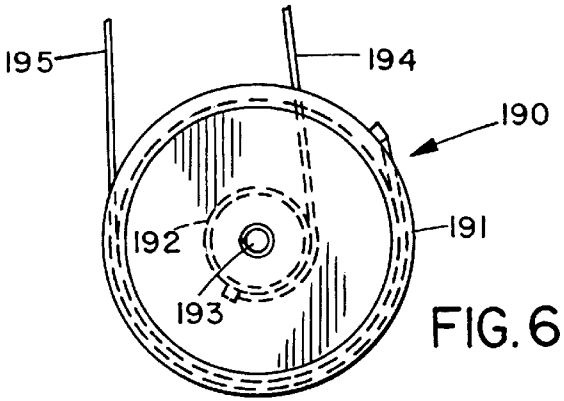
FIG. 6A is a side elevation view of a cam and pulley drive element for increasing or decreasing resistance to the ROM block of FIGS. 1 to 3 or FIGS. 4A and B.

FIGS. 6A and 6B illustrate a cam and pulley device 190 which may be placed in the cable path from the ROM block to the weight stack in order to either increase or decrease the resistance to the ROM block. The device 190 comprises a pair of pulleys or cams 191,192 mounted for rotation about a common axis 193. The first pulley is of larger diameter than the second pulley 192. In the illustrated embodiment, pulley 192 has a diameter three times smaller than that of the larger pulley, although different ratios may be used in different embodiments. In the illustrated embodiment, cable 72 may be linked via side 195 to the resistance or load (i.e. the larger diameter pulley or cam) and not side 194. This will increase load at the exercise station. Alternatively, the connections may be reversed to decrease load at the exercise station.

Figure 7B:
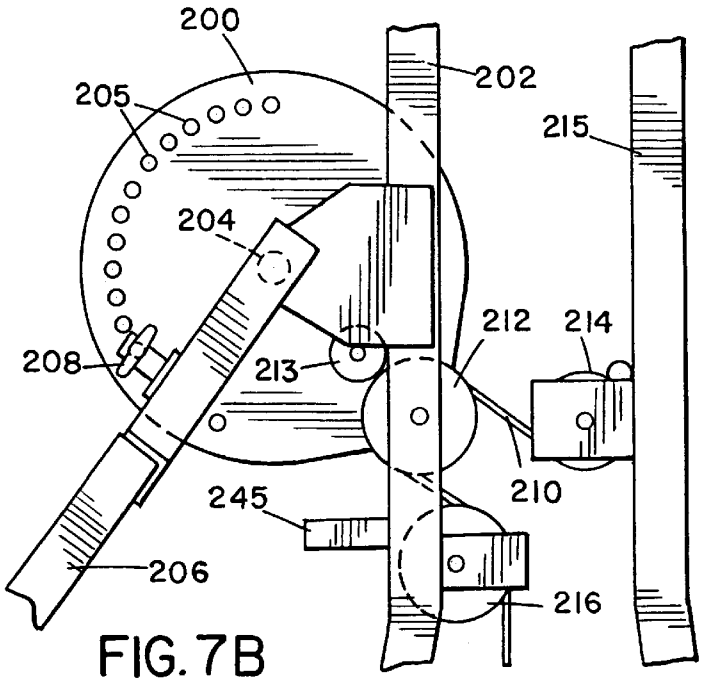
FIG. 7B is a side elevation view similar to FIG. 7A, illustrating a different lever arm position.
Figure 7A:
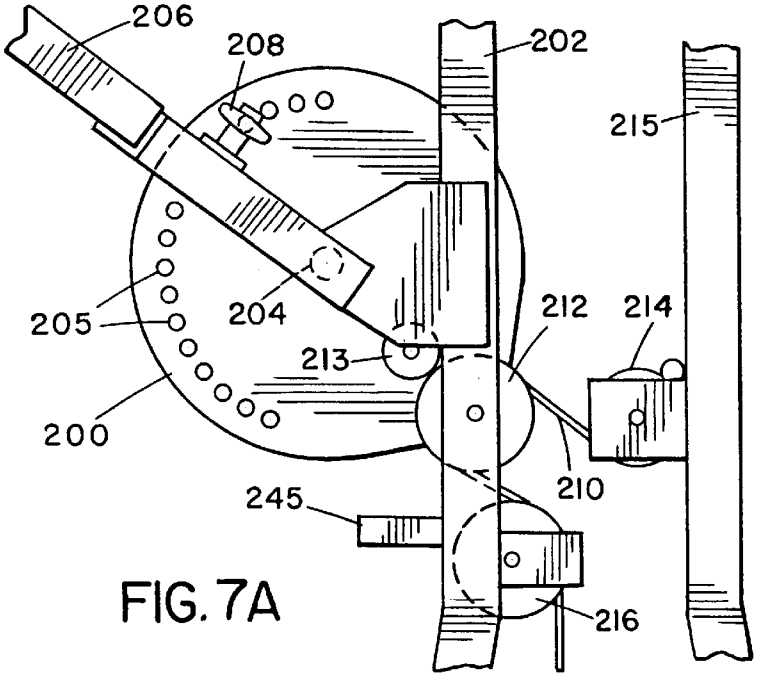
FIG. 7A is a side elevation view of part of an exercise apparatus according to another embodiment of the invention in which a modified, bi-directional ROM block and lever arm arrangement is installed on the upright strut of the support frame.

FIGS. 7A and 7B illustrate a modified range-of-motion or ROM device 200 which is pivoted to an upright member or strut 202 on the support frame, rather than to the top of the support frame as in FIGS. 1 to 3. Additionally, unlike the first embodiment, the ROM device of this embodiment is bi-directional, as illustrated in FIGS. 8 and 9. In other words, the ROM device can be used to provide exercise resistance in two, opposite directions.

As illustrated in FIGS. 7A and 7B, the ROM device 200 comprises a plate which is rotatably mounted on the strut 202 via pivot 204. Plate 200 has a series of spaced openings 205 extending in an arc around the periphery of the plate. Lever arm 206 is also pivotally mounted at one end on the pivot 204, and may be secured at any desired orientation relative to the pivot plate by means of dowel or push pin 208. FIG. 7A illustrates the lever arm 206 secured at an upwardly inclined orientation for performing pull down exercises as in FIG. 8A, and FIG. 7B illustrates the lever arm 206 secured at a downwardly inclined orientation for performing push up or chest press exercises as in FIG. 9A.

A cable 210 extends around a pulley 212 rotatably mounted on the plate 200 in order to link the plate to a suitable exercise resistance such as a weight stack or the like. A small guide wheel 213 or the like is mounted on the plate adjacent pulley 212 to guide the cable against the pulley 212. The first end of the cable 210 is tied off around a pulley 214 mounted on another upright member 215 on the frame. Alternatively, it may extend around pulley 214 for connection to another exercise station. The second end is suitably linked to an exercise resistance such as a weight stack (not illustrated). Clearly, the cable 210 may be linked to the weight stack in numerous different ways, either directly or via one or more floating pulleys to provide other cable connections to exercise stations, for example as illustrated in FIGS. 5A to 5D. In the example illustrated in FIGS. 8A and 9A, the cable 210 extends over a second pulley 216 secured to upright member 202, and then down around pulley 217 at the lower end of the frame, then upwardly to a floating pulley 219. Pulley 219 is a double floating pulley. A first cable 220 is connected to an exercise station at pulley 230, loops under a first pulley of the double floating pulley 219, over a single floating pulley 222, back down under the second pulley of double floating pulley 219, then extends over pulleys 231,232 to a leg extension station 233. Cable 221 is attached at one end to the load (not illustrated) and attached to floating pulley 222 at the opposite end. The cable 210 is therefore linked to the load at one end, engages the bi-directional ROM device 200, and then either attaches to the frame or continues on to another exercise device.

Figure 8A:
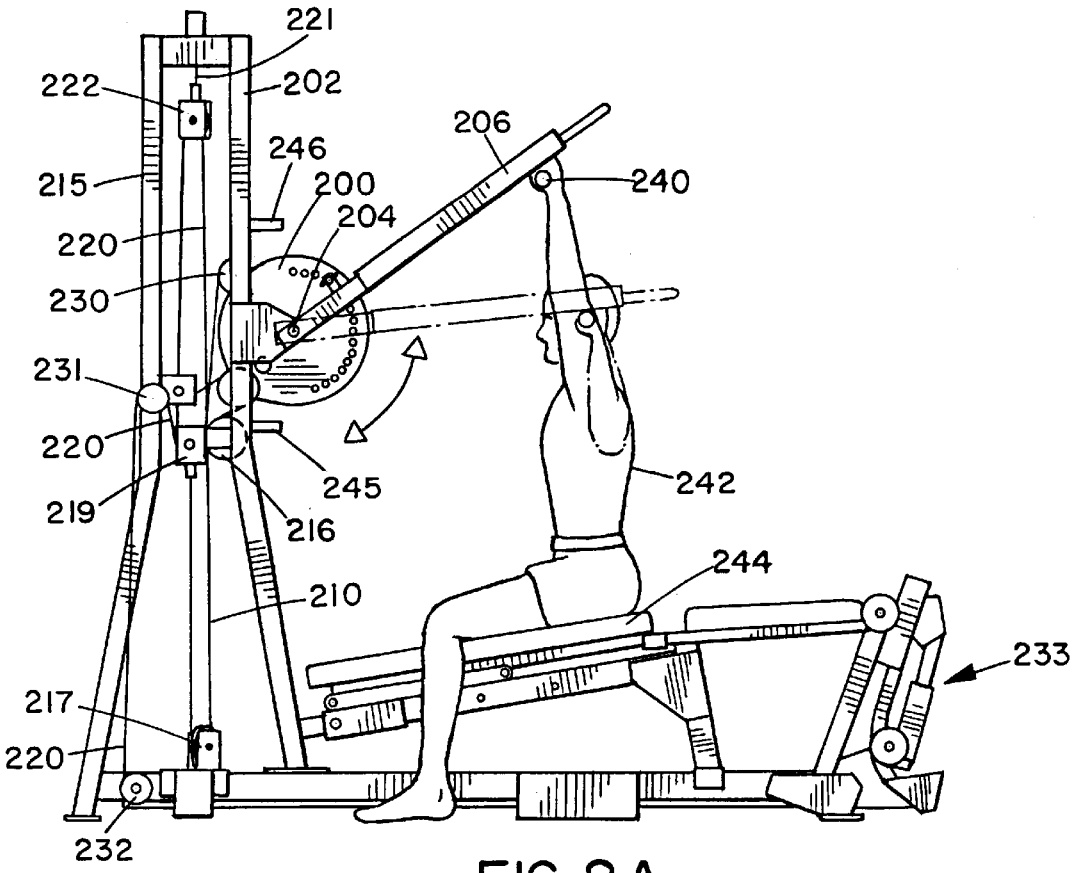
FIG. 8A is a side elevation view of the complete exercise apparatus incorporating the arrangement of FIGS. 7A and 7B, viewed from the opposite direction to FIGS. 7A and 7B, illustrating performance of a lat pull-down exercise.
Figure 8B:
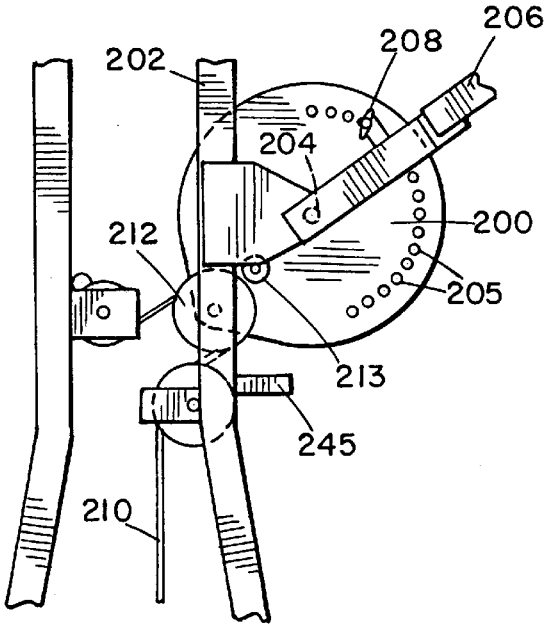
FIG. 8B is an enlarged view of the ROM block and lever arm of FIG. 8A, illustrating the orientation of the lever arm at the start of the lat pull-down exercise in more detail.
Figure 8C:
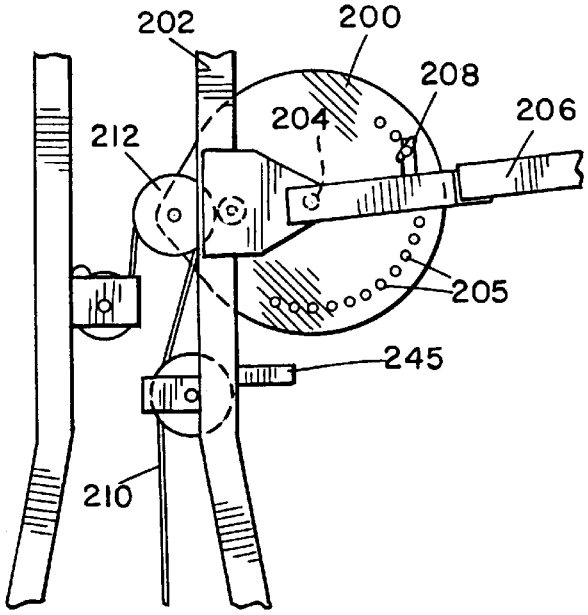
FIG. 8C is a view similar to FIG. 8B but illustrating the midpoint of the pull-down exercise.
Figure 9A:
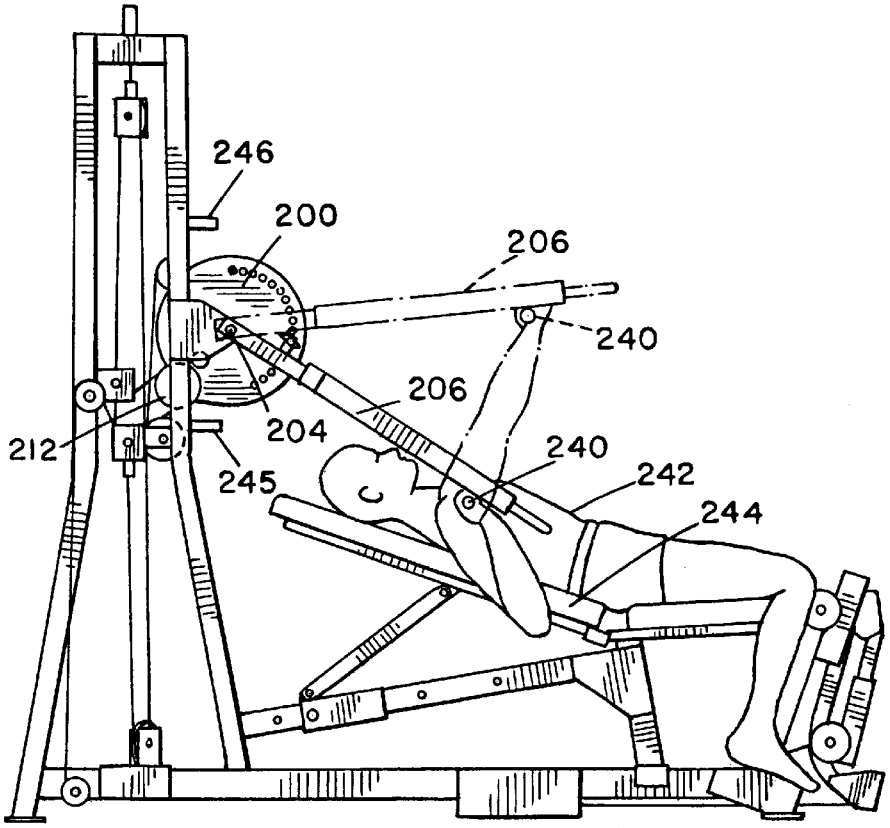
FIG. 9A illustrates the apparatus of FIG. 8A arranged for performing a chest press exercise in the opposite direction to the exercise of FIGS. 8A to 8C.

As illustrated in FIG. 8A, the lever arm 206 has handles 240 at its free end for gripping by a seated user 242 in performing either a lat pull-down exercise as in FIG. 8A, or by a reclining user in performing a chest press exercise as in FIG. 9A. As illustrated in FIG. 8A, with the lever arm 206 secured to the ROM plate 200 at an upwardly inclined orientation as illustrated in solid outline, the user reaches upwardly to grip the handles 240, and then pulls the lever arm downwardly to the dotted outline position against the force of the exercise resistance. FIG. 8B illustrates the start position of the lever arm for a lat pull-down exercise, while FIG. 8C illustrates the mid-point of the exercise motion.

Figure 9B:
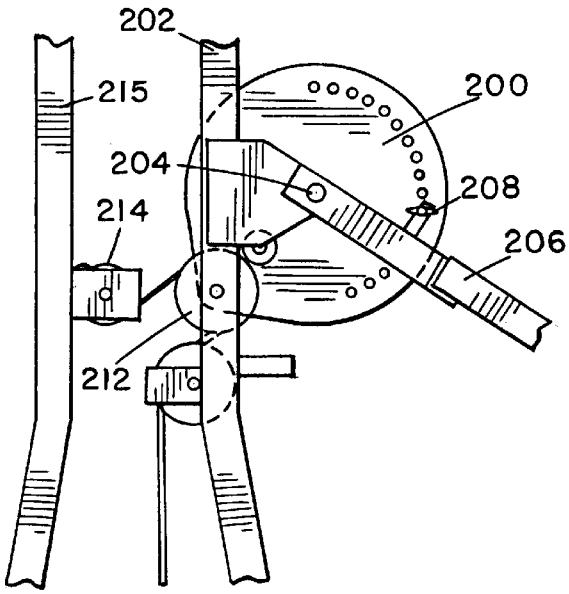
FIG. 9B is an enlargement of the ROM block and lever arm arrangement of FIG. 9A illustrating the start of the chest press exercise.
Figure 9C:
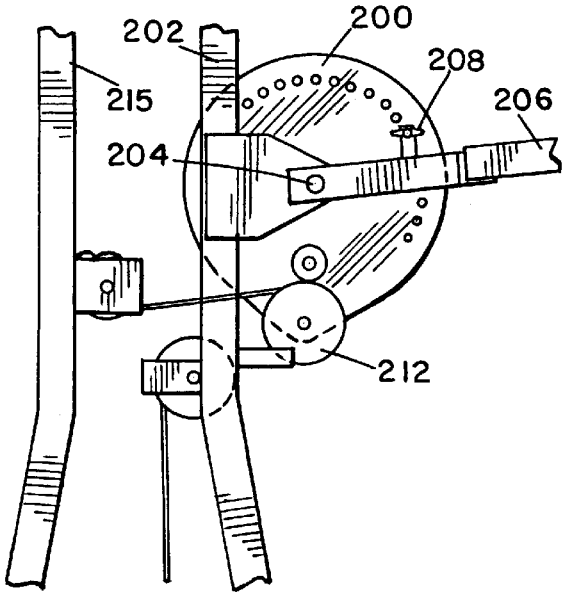
FIG. 9C is a view similar to FIG. 9B but illustrating a midpoint in the chest press exercise.

FIGS. 9A to 9C illustrate the same device used for a chest press exercise. The lever arm 206 is initially located in a downwardly inclined orientation as indicated in solid outline in FIG. 9A. FIG. 9B illustrates the start position for a chest press exercise in more detail. The user reclines on the seat 244 as illustrated in FIG. 9A, gripping the handles 240 close to his or her chest. The user then pushes the handles and lever arm upwardly to the dotted line position of FIG. 9A, which is illustrated in more detail in FIG. 9C. The exercise is repeated as desired. Stops 245,246 are provided on the frame to limit the clockwise or downward and anti-clockwise or upward movement of the lever arm, respectively.

Thus, the lever arm and ROM device of FIGS. 7 to 9 has a bi-directional range of motion, since it is movable from the center of the range of motion in two opposite directions against the resistance of the weight stack or other exercise resistance device. The start position for the lat pull-down and the chest press is illustrated in FIGS. 8B and 9B, respectively. If the lever arm is rotated in a clockwise direction from the start position of FIG. 8B, the cable linkage pulley is moved up from the position of FIG. 8B to that of FIG. 8C, extending the cable and thus working against the exercise resistance. Similarly, if the lever arm is rotated in an anti-clockwise direction from the equivalent start position of FIG. 9B, the cable linkage pulley is moved down also extending the cable and working against the exercise resistance. Thus, the ROM device and lever arm are bi-directional in this embodiment. When not in use, the lever arm will tend to swing down until it rests against the lowermost stop 245. The operation of the constant tension or range of motion device in this embodiment is otherwise identical to that of the first embodiment.

Figure 10A:
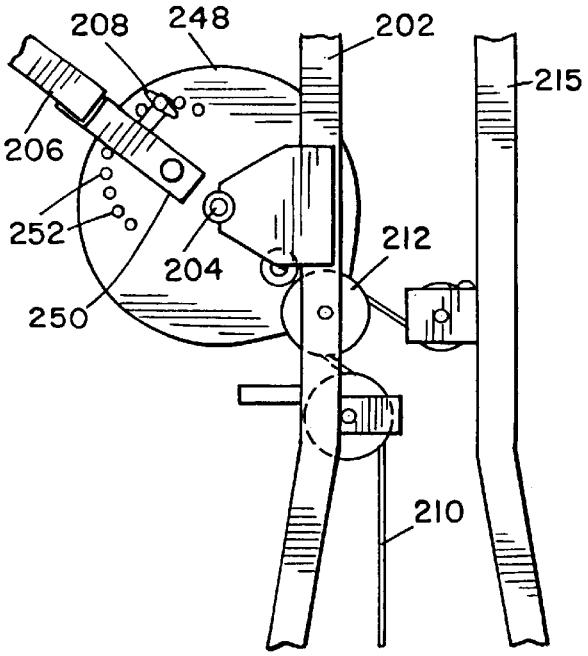
FIG. 10A is a side elevation view similar to FIG. 7A but illustrating another embodiment of the bi-directional ROM block and lever arm.
Figure 10B:
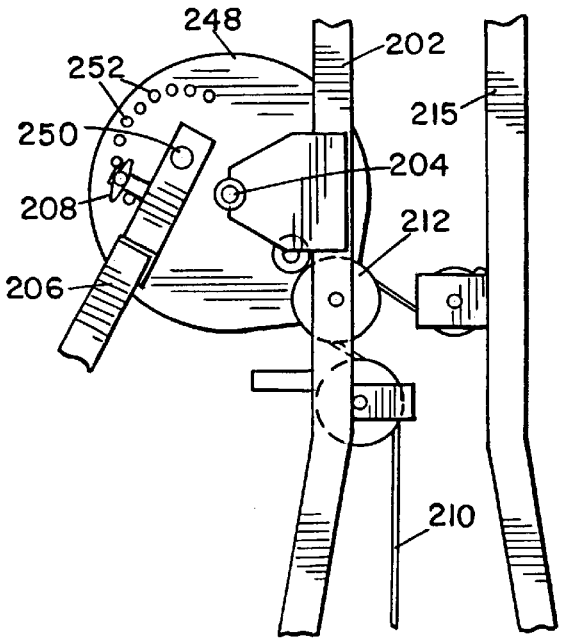
FIG. 10B is a side elevation view of the ROM block and lever arm of FIG. 10A with the lever arm secured in a different orientation.

FIGS. 10A and 10B illustrate a range of motion device 248 similar to that of the previous embodiment, and like reference numerals have been used for like parts as appropriate. However, unlike the previous embodiment, the lever arm 206 is not pivoted on the same pivot axle as the ROM plate 248. Instead, in this alternative, the lever arm is pivoted via pivot pin 250 to the plate 248 itself, at a location spaced radially outwardly from plate pivot axis 204.

The plate has a series of holes 252 extending in an arc centered on pivot axis 250 of the lever arm, and the lever arm can be secured at a desired orientation by selection of an appropriate hole and engaging push pin 208 in the aligned hole. FIGS. 10A and 10B illustrate two of the possible orientations. As in the previous embodiment, a pulley 212 is pivotally mounted at the periphery of plate 248 at a location spaced from holes 252. Operation of the ROM device in this case is therefore similar to that of the previous embodiment, apart from the separate pivot axes, which result in a slightly different orientation or range of orientation for lever arm 206.

In the embodiments of FIGS. 7 to 10, the cable end is illustrated as attached to the frame at one end after passing over the pulley 212 on the bi-directional ROM plate. However, it may alternatively be extended to other exercise devices if desired, such as a pulling handle, a leg extension device, or an overhead pull down device, or the like.

While a full and complete disclosure of some preferred embodiments of the present invention is set forth above, it is to be understood that various modifications, alternate constructions, and equivalent structures may be used without departing from the spirit of the present invention, and that the only limitations intended for the present invention are defined by the appended claims.

I claim:

1. An exercise apparatus, comprising:

a support frame having a front end and a rear end, and a central axis extending from said front end to said rear end, said frame including a base, an upright portion extending upwardly from said base at a location on said central axis and having an upper end and a lower end, and a top strut secured to the upper end of said upright portion;

a seat on said frame centered on said central axis and aligned with said upright portion;

resistance means on said support frame for providing resistance to exercises performed on said apparatus;

an adjustment member pivotally mounted on said upright portion, at a location spaced between said upper and lower ends for rotation about a first pivot axis, the adjustment member having a series of spaced holes extending along an arc;

a lever arm pivotally mounted relative to said adjustment member on the same first pivot axis as said adjustment member and rotatable into any one of a series of selected orientations relative to said adjustment member;

a connecting pin for releasably connecting said lever arm to any selected one of said holes in said adjustment member to secure said lever arm at a selected orientation relative to said adjustment member whereby said lever arm and adjustment member are rotatable together about said pivot axis;

the adjustment member having a first position relative to said frame and being pivotable in opposite directions from said first position toward different extended positions, whereby a user can rotate said lever arm and adjustment member together in opposite directions from said first position towards said extended positions;

a cable and pulley linkage linking said resistance means to said lever arm, whereby a user can rotate said lever arm in opposite directions from said first position towards said extended positions against the resistance of said resistance means;

said cable and pulley linkage including at least one pulley attached to said adjustment member, at least one pulley attached to said frame, and a cable extending at least partially around each of said pulleys; and a first stop member having a first end secured to said upright portion of said frame at a location spaced below said adjustment member and a second end, said first stop member comprising a stop defining a first stop position and comprising means for engaging said lever arm and limiting rotation of said adjustment member and lever arm in a first direction beyond said first stop position.

2. The apparatus as claimed in claim 1, wherein at least part of said adjustment member comprises a flat plate and said holes extend in an arc across said flat plate.

3. The apparatus as claimed in claim 1, wherein the cable has a first end linked to said resistance means and a second end extending beyond said pulleys for attachment to the frame.

4. The apparatus as claimed in claim 1, including a second stop member secured to said upright portion of said frame at a location spaced above said adjustment member, said second stop member defining a second stop position and comprising means for engaging said lever arm and limiting rotation of said adjustment member and lever arm in a second direction opposite to said first direction beyond said second stop position.

5. The apparatus as claimed in claim 1, wherein said lever arm has a first extended position engaging said first stop member in which said lever arm extends vertically downwardly away from said top strut.

6. An exercise apparatus, comprising:

a support frame having a front end and a rear end, and a central axis extending from said front end to said rear end, said frame including a base, an upright portion extending upwardly from said base at a location on said central axis and having an upper end and a lower end, and a top strut secured to the upper end of said upright portion;

a seat on said frame centered on said central axis and aligned with said upright portion;

resistance means on said support frame for providing resistance to exercises performed on said apparatus;

an adjustment member pivotally mounted on said upright portion at a location spaced between said upper and lower ends for rotation about a first pivot axis, the adjustment member having a series of spaced holes extending along an arc;

a lever arm pivotally mounted relative to said adjustment member and rotatable into any one of a series of selected orientations relative to said adjustment member;

a connecting pin for releasably connecting said lever arm to any selected one of said holes in said adjustment member to secure said lever arm at a selected orientation relative to said adjustment member whereby said lever arm and adjustment member are rotatable together about said pivot axis;

the adjustment member having a first position relative to said frame and being pivotable in opposite directions from said first position toward different extended positions, whereby a user can rotate said lever arm and adjustment member together in opposite directions from said first position towards said extended positions;

a cable and pulley linkage linking said resistance means to said lever arm, whereby a user can rotate said lever arm in opposite directions from said first position towards said extended positions against the resistance of said resistance means;

said cable and pulley linkage including at least one pulley attached to said adjustment member, at least one pulley attached to said frame, and a cable extending at least partially around each of said pulleys; and a first stop member having a first end secured to said upright portion of said frame at a location spaced below said adjustment member and a second end, said first stop member comprising a stop defining a first stop position and comprising means for engaging said lever arm and limiting rotation of said adjustment member and lever arm in a first direction beyond said first stop position.

7. The apparatus as claimed in claim 6, wherein said resistance means comprises a weight stack and said cable and pulley linkage includes a cable linked to said weight stack, whereby rotation of said lever arm and adjustment member raises said weight stack.

8. The apparatus as claimed in claim 6, wherein said lever arm comprises a pull-down member.

9. The apparatus as claimed in claim 6, wherein said adjustment member comprises a plate, said plate being of generally circular cross-section, said pivot axis being located approximately at the center of said plate, and said holes extending around part of the periphery of said plate on one side of said pivot axis.

10. The apparatus as claimed in claim 9, wherein said pulley attached to said adjustment member comprises a first pulley rotatably mounted on a portion of the periphery of said plate spaced from said holes.

11. The apparatus as claimed in claim 6, wherein said cable and pulley linkage includes at least one pulley device mounted in said cable path, the pulley device having a first pulley of a first diameter mounted for rotation about a second pivot axis, and a second pulley of a second diameter different from said first diameter mounted for rotation about said second pivot axis, the adjustment member being linked to said first pulley and the resistance means being linked to said second pulley.

12. The apparatus as claimed in claim 6, wherein the lever arm is pivotally mounted on said adjustment member for rotation about the same pivot axis as said adjustment member.

13. The apparatus as claimed in claim 10, including a guide wheel rotatably mounted on said adjustment member adjacent said one pulley.

14. An exercise apparatus, comprising:

a support frame having a front end and a rear end, and a central axis extending from said front end to said rear end, said frame including a base, an upright member extending upwardly from said base at a location on said central axis and having a lower end secured to said base and an upper end and a top strut secured to the upper end of said upright member;

a seat mounted on said frame in front of said upright member centered on said central axis and aligned with said upright member;

resistance means on said support frame for providing resistance to exercises performed on said apparatus;

an adjustment member pivotally mounted on said upright member at a location above said seat and spaced between said ends for rotation about a first pivot axis;

a lever arm pivotally mounted relative to said adjustment member and rotatable into any one of a series of selected orientations relative to said adjustment member, the lever arm comprising means for selectively performing lat pull-down and chest press exercises;

an adjustment mechanism having a first part mounted on said adjustment member and a second part mounted on said lever arm;

one part of said adjustment mechanism comprising a plate having a series of spaced holes extending along an arc;

the other part comprising a connecting pin for releasable insertion in any selected one of said holes in said one part to secure said lever arm at a selected orientation relative to said adjustment member whereby said lever arm and adjustment member are rotatable together about said pivot axis;

the adjustment member having a first position relative to said frame and being pivotable in opposite directions from said first position toward different extended positions, whereby a user can rotate said lever arm and adjustment member together in opposite directions from said first position toward said extended positions;

a cable and pulley linkage linking said resistance means to said lever arm whereby a user can rotate said lever arm in opposite directions from said first position towards said extended positions against the resistance of said resistance means;

said cable and pulley linkage including at least one pulley attached to said adjustment member, at least one pulley attached to said frame, and a cable extending at least partially around each of said pulleys;

the cable having a first end linked to said resistance means and a second end extending beyond said pulleys for attachment to a further exercise device;

said lever arm being pivotally mounted on said adjustment member for rotation about a second pivot axis spaced from said first pivot axis; and said second pivot axis being located between said arc and said first pivot axis.

* * * * *